US007561125B2

(12) United States Patent
Kim et al.

(10) Patent No.: US 7,561,125 B2
(45) **Date of Patent: *Jul. 14, 2009**

(54) DATA DRIVE CIRCUIT FOR CURRENT WRITING TYPE AMOEL DISPLAY PANEL

(75) Inventors: Hak Soo Kim, Seoul (KR); Young Sun Na, Kyonggi-do (KR); Oh Kyoung Kwan, Kyongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 521 days.

This patent is subject to a terminal disclaimer.

(21) Appl. No.: 11/249,353

(22) Filed: Oct. 14, 2005

(65) Prior Publication Data

US 2006/0028411 A1 Feb. 9, 2006

Related U.S. Application Data

(63) Continuation of application No. 10/336,743, filed on Jan. 6, 2003, now Pat. No. 6,982,687.

(30) Foreign Application Priority Data

Jan. 9, 2002 (KR) ..... 10-2002-1175

(51) Int. Cl.
*G09G 3/30* (2006.01)

(52) U.S. Cl. ..... 345/76; 345/77

(58) Field of Classification Search ..... 345/74.1, 345/76, 77, 82, 87, 92, 100, 204, 203, 590, 345/690, 205, 212; 313/505, 506; 315/169.3
See application file for complete search history.

(56) References Cited

U.S. PATENT DOCUMENTS 6,091,203 A 7/2000 Kawashima et al.
6,097,359 A 8/2000 Kwon et al.
6,323,631 B1 11/2001 Juang
6,982,687 B2 * 1/2006 Kim et al. ..... 345/76
7,129,914 B2 * 10/2006 Knapp et al. ..... 345/76
7,283,108 B2 * 10/2007 Kasai ..... 345/76

(Continued)

FOREIGN PATENT DOCUMENTS

CN 1312535 A 9/2001

(Continued)

OTHER PUBLICATIONS

Japanese Office Action Dated Jan. 17, 2006.

*Primary Examiner*—Prabodh M. Dharia
(74) *Attorney, Agent, or Firm*—Holland & Knight LLP

(57) ABSTRACT

Data drive circuit for a current writing type AMOEL display panel including a plurality of current output channels, and a plurality of channel current generating circuits on respective current output channels for minimizing a difference of current levels occurred between the current output channels, each inclusive of one pair of transistors, a current generating part for generating a current of a small deviation proportional to square of a difference of threshold voltages of the one pair of the transistors, and a current mirror part for mirroring the current, and forwarding the mirrored current as a channel current for the channel, thereby minimizing a difference of current levels occurred between output channels, and driving the AMOEL display panel uniformly.

11 Claims, 3 Drawing Sheets

U.S. PATENT DOCUMENTS

| | | | | |
|---|---|---|---|---|
| 2003/0128202 | A1* | 7/2003 | Kim et al. | 345/212 |
| 2005/0168490 | A1* | 8/2005 | Takahara | 345/690 |

FOREIGN PATENT DOCUMENTS

| | | | |
|---|---|---|---|
| EP | 1039440 | A1 | 9/2000 |
| EP | 1130781 | A2 | 9/2001 |
| EP | 1282103 | A2 | 2/2003 |
| JP | 06-314977 | | 11/1994 |
| JP | 2000-122608 | | 4/2000 |
| JP | 2001-308340 | A | 11/2001 |

* cited by examiner

DATA DRIVE CIRCUIT FOR CURRENT WRITING TYPE AMOEL DISPLAY PANEL

This application is a Continuation Application of U.S. patent Ser. No. 10/336,743 now U.S. Pat. No. 6,982,687 B2 filed on Jan. 6, 2003 which claims the benefit of the Korean Application No. P 2002-1175, filed on Jan. 9, 2002, whose entire disclosures are incorporated herein by reference herein.

BACKGROUND OF THE INVENTION

1. Field of the Invention

The present invention relates to a data drive circuit for a current writing type AMOEL display panel.

2. Background of the Related Art

In general, there are two kinds of AMOEL (Active Matrix Organic ElectroLuminescent) pixel structures; a voltage writing type pixel structure and a current writing type pixel structure. The AMOEL display panel of the current writing type pixel structure is sensitive to noises, such as variation of a threshold voltage, and an irregular voltage rise at an earth line.

FIG. 1 illustrates a related art circuit of a voltage writing type pixel structure of two positive elements.

Referring to FIG. 1, there is a charge storage capacitor Cstg having both a drive transistor Q1 for direct driving of an organic electroluminescent (OEL) and a positive power source $V_{DD}$ connected thereto, for storage of charge of a TFT-LCD (Thin Film Transistor-Liquid Crystal Display). The drive transistor Q1 has one side connected to an anode of the OEL. There is a switching transistor Q2 having a gate connected to a scanline for switching the OEL under the control of a signal from the scanline. The switching transistor Q2 has a source connected to a dataline, a drain connected to a gate of the drive transistor Q1. The charge storage capacitor Cstg is connected both to the positive power source VDD and the gate of the drive transistor Q1. As shown in FIG. 1, the drive transistor Q1 and the switching transistor Q2 are PMOS (P type Metal Oxide Semiconductor)

The operation of the circuit in FIG. 1 will be explained.

A data voltage having a gray scale adjusted is provided from the dataline both to the charge storage capacitor Cstg and the gate of the drive transistor Q1 through the switching transistor Q2. When the switching transistor Q2 is closed in response to the scanline signal, a data voltage of the gray scale of each pixel is written on the charge storage capacitor Cstg through the dataline. The written data voltage is used as a control voltage for fixing a current level of the drive transistor Q1. The current by the control voltage is provided to the OEL through the drive transistor Q1. The AMOEL panel has lots of pixels, wherein, if voltage-current characteristics of the drive transistors Q1 between the pixels are not uniform, currents to the OELs in the pixels are not uniform, even if the voltages written on the charge storage capacitors Cstg are the same, which results in a non-uniform display, i.e., non-uniform luminance, on the AMOEL display panel, that is one of disadvantages of the voltage writing type.

FIG. 2 illustrates a circuit of a related art pixel of the current writing type. Different from the voltage writing type shown in FIG. 1, a current level of the gray scale is written on the drive transistor P1, directly.

Referring to FIG. 2, if a data drive circuit for providing a write current Idata is operable uniformly, the organic EL panel can display uniformly, even if the voltage-current characteristics of the drive transistors P1 of the pixels are not uniform. However, FIG. 2 illustrates a data drive circuit for only one pixel, actually. That is, a part for providing the writing current is present, not as only one circuit in the data drive circuit part, but for every dataline, or a few datalines. Therefore, if there are errors among the circuits that provide the writing currents, the pixels of the current writing type can not be make the best use of their advantages, such that the organic EL panel fails to have uniform display characteristics.

For solving the problem of FIG. 2, a circuit illustrated in FIG. 3 may be used. FIG. 3 illustrates a circuit for mirroring a reference current source IEF for providing desired current sources. In this case, one reference current source is employed in the data drive circuit. However, referring to FIG. 3, if one reference current source is mirrored to all the datalines, the reference current source can not exactly be mirrored, if a distance between transistors that act as mirrors is too far from the reference current source.

Referring to FIG. 4, as another method, a circuit for correcting the reference current source IREF can be employed. In a case of this circuit, current source devices, such as transistors, and charge storage capacitors may be used for making calibration periods equal for the datalines. However, a current leakage between a gate and a source of the charge storage transistor causes voltage variations on the datalines, and non-uniform output currents between the datalines.

SUMMARY OF THE INVENTION

Accordingly, the present invention is directed to a data drive circuit for an AMOEL display panel having a current writing type pixel structure that substantially obviates one or more of the problems due to limitations and disadvantages of the related art.

An object of the present invention is to provide a data drive circuit for an AMOEL display panel having a current writing type pixel structure, in which a difference between output current levels is minimized in channels for making uniform driving of an AMOEL panel having a current writing type pixel structure.

Another object of the present invention is to provide a data drive circuit for a current writing type AMOEL display panel, which can make uniform and accurate display of a data on an AMOEL display channel according to a size of a current flowing through the AMOEL display panel.

Further object of the present invention is to provide a data drive circuit for a TFT-AMOEL or single crystalline AMOEL display panel having a current writing type pixel structure.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the data drive circuit for a current writing type AMOEL display panel including a plurality of current output channels, and a plurality of channel current generating circuits on respective current output channels for minimizing a difference of current levels occurred between the current output channels, each inclusive of one pair of PMOS transistors having the same widths and lengths and a common gate terminal, a first bias circuit connected to the common gate terminal of the pair of PMOS transistors for prevention of floating of the common gate terminal, a first NMOS transistor for receiving an output current from the pair of PMOS transistors, n (n=1, 2, 3, - - - ) second NMOS transistors connected to a gate terminal of the first NMOS transistor, each for forming a current mirror with the first NMOS transistor for mirroring the output current from the pair of the PMOS transistors, and n PMOS transistors respectively connected to the n second NMOS transistors in series, wherein outputs of the n PMOS transistors are connected in parallel.

Preferably, the pair of PMOS transistors have the same widths and lengths.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
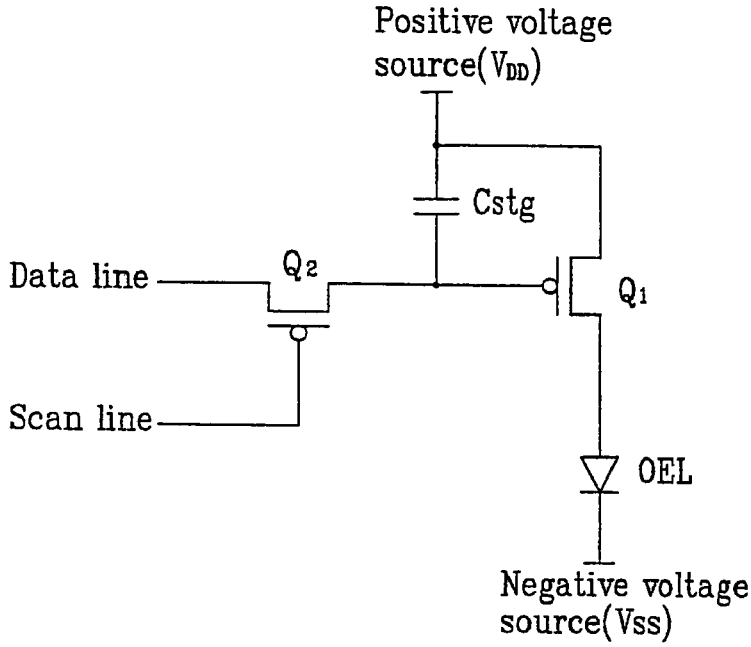
FIG.1 Prior Art
FIG. 1 illustrates a related art data drive circuit for a voltage writing type display panel with two positive elements.
Figure 2:
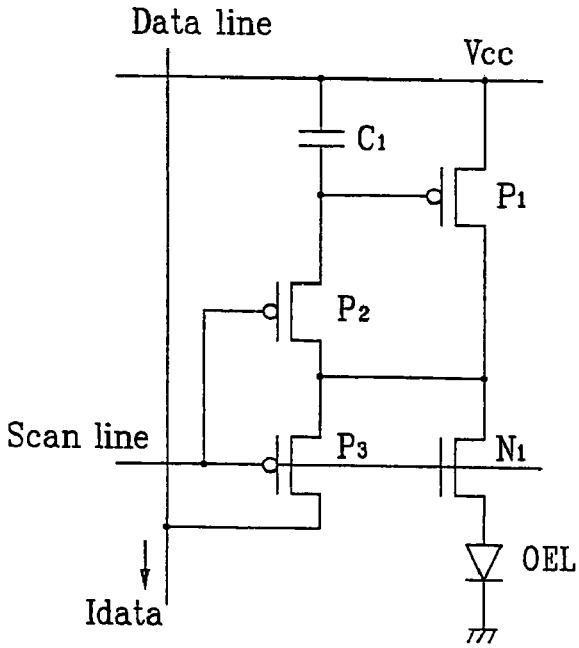
FIG.2 Prior Art
FIG. 2 illustrates a related art data drive circuit for a current writing type display panel.
Figure 3:
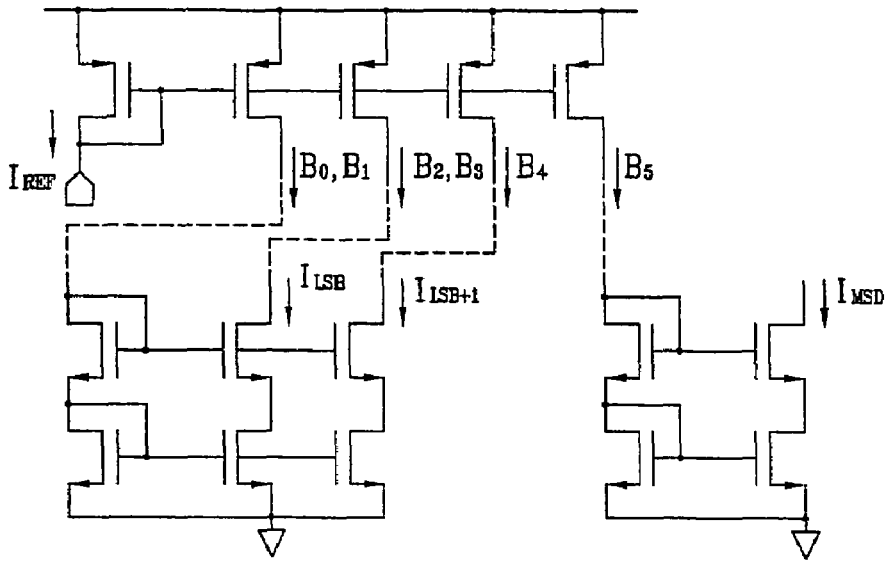
FIG. 3 Prior Art
FIG. 3 illustrates a related art data drive circuit for a current writing type display panel having a method for mirroring a reference current source applied thereto.
Figure 4:
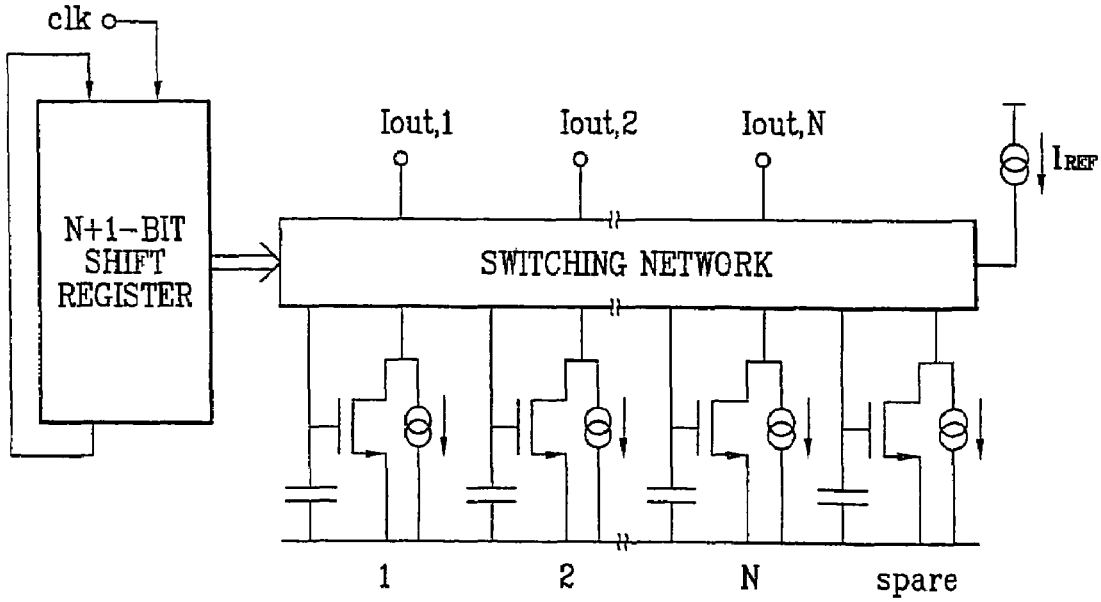
FIG. 4 Prior Art
FIG. 4 illustrates a related art data drive circuit for a current writing type display panel having a method for correcting by using a reference current source applied thereto.
Figure 5A:
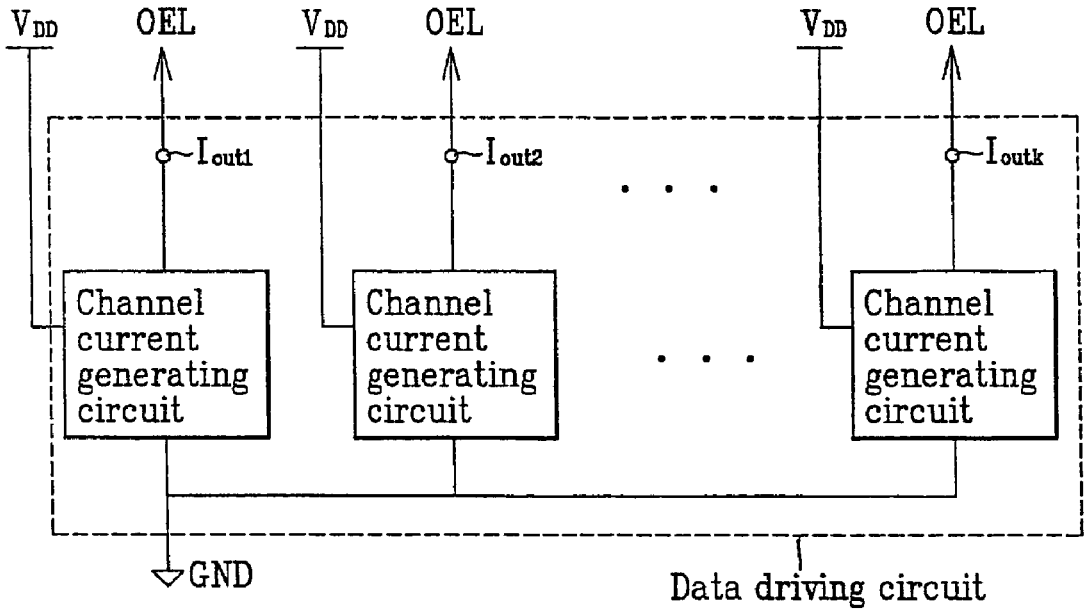
FIG. 5A illustrates a data drive circuit for a current writing type AMOEL display panel in accordance with a preferred embodiment of the present invention.

Reference will now be made in detail to the preferred embodiments of the present invention, examples of which are illustrated in the accompanying drawings FIGS. 5A and 5B. FIG. 5A illustrates a block diagram of a data drive circuit for a current writing type AMOEL display panel in accordance with a preferred embodiment of the present invention.

Referring to FIG. 5A, the data drive circuit includes a plurality of current output channels Iout1, Iout2, - - - , Ioutk, and a plurality of channel current generating circuits at respective current output channel positions for minimizing differences of current levels occurred between the current output channels Iout1, Iout2, - - - , Ioutk.

Figure 5B:
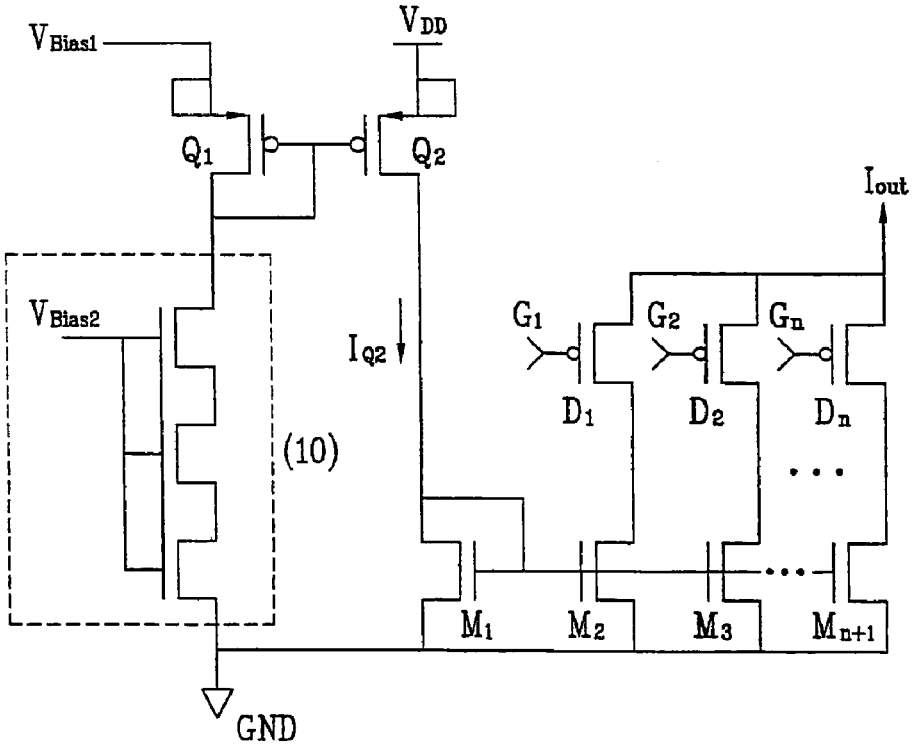
FIG. 5B illustrates a detailed circuit of each of the channel current generating circuits in FIG. 5A.

Referring to FIG. 5B, the channel current generating circuit includes one pair of PMOS transistors Q1 and Q2 having the same width and length with the current output channel Iout and a common gate terminal, a bias circuit 10 connected to the common gate terminal of the pair of the PMOS transistors Q1 and Q2 for prevention of floating of the common gate terminal, a first NMOS transistor M1 for receiving a current from the pair of PMOS transistors Q1 and Q2, n second NMOS transistors M2, M3, - - - , Mn+1 each having a gate terminal in common with the gate terminal of the first NMOS transistor M1, to form a current mirror circuit with the first NMOS transistor M1 for mirroring an current $I_{Q2}$ from the pair of the PMOS transistors Q1 and Q2, and n second PMOS transistors D1, D2, - - - , Dn respectively connected to output sides of the n second NMOS transistors M2, M3, - - - , Mn+1 having outputs connected in parallel to form one of the current output channels Iout1, Iout2, - - - , Ioutk.

Referring to FIG. 5B, one of the pair of PMOS transistors Q1 and Q2 has a body and a source connected to each other connected to a first external bias $V_{Bias1}$, and the common gate terminal of the pair of the PMOS transistors is connected to the external bias circuit 10 for prevention of floating. The external bias circuit includes three NMOS transistors connected between the common gate terminal and the ground having a second external bias $V_{Bias2}$ used as a common gate voltage.

In the meantime, each of the n PMOS transistors D1, D2, - - - , Dn receives an one bit external digital gate signal for controlling a current to a relevant NMOS transistor M. Currents from the second PMOS transistors D1, D2, - - - , Dn are added together in parallel and provided as one driving current to one of the current output channels. The driving current is regulated to have a current level of a binary form by combination of n-bit digital signals to the n PMOS transistors D1, D2, - - - , Dn. The width and length of each of the n second NMOS transistors M2, M3, - - - , Mn+1 is fixed so that a current thereto is to be a $2^a$ (a=0, 1, - - - ) times of a current IQ2 from the pair of PMOS transistors.

As explained, according to the embodiment, a current, having small variation, proportional to square of a difference of threshold voltages of the PMOS transistors Q1 and Q2 is generated by using the pair of the PMOS transistors Q1 and Q2, and mirrored by n current mirror circuits of n+1 NMOS transistors M1, M2, - - - , Mn+1. An output current from each of the current mirror circuits are adjusted by a relevant second PMOS transistor 'D' and added together in parallel. The added value is a current value of one channel. Each of the channel current values obtained thus minimizes a difference of levels of the driving currents between channels, and makes uniform operation of the AMOEL display panel.

Moreover, referring to FIG. 5B, even if voltages induced at the output channels are different due to differences of effective ground resistances in view of respective output channels, voltage rises at the output channels caused by the differences of ground resistances give no great influence to the output currents of the channels, because the current $I_{Q2}$ generated at the pair of the PMOS transistors Q1 and Q2 is mirrored by the n current mirror circuits of the n+1 NMOS transistors M1, M2, - - - , Mn+1. The effect of the voltage rise at the ground line is offset.

When the data drive circuit has many channels, required very long ground line the channels have in common, the effective resistances of the ground lines between the channels distanced far away from each other are different. If the ground resistances between the channels are different, voltages induced at the ground lines are different. However, referring to FIG. 5B, the current $I_{Q2}$ from the pair of the PMOS transistors Q1 and Q2 is very small compared to the drive currents of the channels which are output currents of current mirror circuits of the n+1 second NMOS transistors M1, M2, M3, - - - , Mn+1, the voltage drop caused by the current $I_{Q2}$ from pair of the PMOS transistors Q1 and Q2 can be neglected.

Moreover, the output current form one channel generated by the pair of PMOS transistors Q1 and Q2 are used after mirrored by the mirror circuits of the NMOS transistors, the voltage rise caused by the difference of ground resistances give no influence to the output current from the channel. Thus, deviations of current levels between channels having different effective ground voltages can be reduced to a small value.

The level of the output current Iout from the channel is fixed by controlling the output currents from the current mirror circuits mirrored a current $I_{Q2}$ of the first NMOS transistor M1 with the n PMOS transistors D1, D2, - - - , Dn. The n second PMOS transistors D1, D2, - - - , Dn control output currents from the current mirror circuits with external n-bit digital signals used as gate signals. The n PMOS transistors D1, D2, - - - , Dn which use the n-bit digital signals as their gate signals are connected to the n second NMOS transistors M2, M3, - - - , Mn+1 in series. Each of the NMOS transistors M2, M3, - - - , Mn+1 has a width and a length of $2^a$ current levels by combination of the n-bits, so as to be one of the $2^a$ times (a=0, 1, 2, - - - ) of the current $I_{Q2}$ from the pair of the PMOS transistors Q1 and Q2.

The current IQ2 to the first NMOS transistor M1 is generated by the pair of the PMOS transistors Q1 and Q2 having the same width and length with the first NMOS transistor M1. The common gate of the pair of the PMOS transistors Q1 and Q2 has the variable resistance connected thereto. The external bias circuit 10 is connected to the common gate of the pair of the PMOS transistors Q1 and Q2. The source and body of the PMOS transistor Q1 are connected to each other, which are in turn connected to the first external bias current source $V_{Bias1}$. The source of the PMOS transistor Q2 is connected to the positive power source $V_{DD}$.

The current $I_{Q2}$ from the PMOS transistor Q2 is can be calculated by the following equations (1) and (2).

$$|I_{Q1}| = K1\,(V_{Bias1} - Vx - |V_{th1}|)^2 \tag{1}$$

Where, $$Vx = V_{Bias1} - |V_{th1}| - \sqrt{(|I_{Q1}|/K1)}, \text{ and}$$

$$\begin{aligned} |I_{Q2}| &= K2\,(V_{DD} - Vx - |V_{th2}|)^2 \\ &= K2\left(V_{DD} - V_{Bias1} + |V_{th1}| - |V_{th2}| + \sqrt{(|I_{Q1}|/K1)}\right)^2 \end{aligned} \tag{2}$$

where, $$K1 = \mu_p C\sigma x\,(W1/L1),$$

$$K2 = \mu_p C\sigma x\,(W2/L2).$$

Referring to equation (2), if the positive power source voltage $V_{DD}$, the first external bias power source $V_{Bias1}$ and $\sqrt{(|I_{Q1}|/K1)}$ are constant, the current $I_{Q2}$ from the PMOS transistor Q2 is proportional to square of a difference of the threshold voltages of the pair of PMOS transistors Q1 and Q2.

This implies that, if the PMOS transistors Q1 and Q2 are close in view of design, the pair of PMOS transistors Q1 and Q2 provide a uniform source current $I_{Q2}$ even if the threshold voltages of the PMOS transistors Q1 and Q2 on respective channels vary when a distance between the current output channels are far.

That is, since the pair of PMOS transistors Q1 and Q2 are close in view of a layout, an output from the pair of the PMOS transistors, i.e., a base current $I_{Q2}$ from the pair of the PMOS transistors Q1 and Q2 has a current value of a small deviation proportional to square of a difference of the threshold voltages of the pair of the PMOS transistors Q1 and Q2, thereby providing comparatively uniform current value.

Moreover, if the pair of the PMOS transistors Q1 and Q2 are far apart, the base current $I_{Q2}$ from the pair of the PMOS transistors Q1 and Q2 is a current of a great deviation proportional to square of a difference of the threshold voltages $V_{th1}$ and $V_{th2}$ of the pair of the PMOS transistors Q1 and Q2.

As explained, since the uniform current $I_{Q2}$ obtained thus passes through the n current mirror circuits of n+1 NMOS transistors positioned close to the pair of PMOS transistors. Q1 and Q2, and a parallel sum of the current mirror circuits is used as an output current Iout from one uniform channel of the data drive circuit.

Moreover, the data drive circuit of the embodiment compensates a difference of ground voltages of channels by the following principle even if the difference is occurred.

As explained, in a case there are many number of current output channels in the data drive circuit, it is required that a common ground line of the channels is very long depending on positions of the channels. The far away channels have different effective resistance of the ground lines.

For an example, if two far away channels have different effective ground resistances, voltages induced at the ground lines are also different depending on the channels.

Since the level of the current $I_{Q2}$ from the pair of the PMOS transistors for one channel in the data drive circuit is so low compared to the channel output current Iout enough to neglect a voltage drop of the positive power source voltage VDD caused by the current $I_{Q2}$ of the pair of the PMOS transistors Q1 and Q2, the voltage rise at the ground line caused by the channel output current Iout acts as a cause to differ the channel output current in a case a current source of NMOS transistors is used simply.

The current $I_{Q2}$ from the pair of the PMOS transistors Q1 and Q2 is used, with the current $I_{Q2}$ mirrored to the current mirror circuit of the n+1 NMOS transistors M1, M2, - - - , Mn+1, the voltage rise at the ground resistance does not affect to the channel output current Iout.

As has been explained, the data drive circuit for a current writing type AMOEL display panel of the present invention has the following advantages.

By using a pair of transistors having a width and a length, a current of a small deviation proportional to square of a difference of threshold voltages of the transistors is provided. Accordingly, different from the related art case when a current of a great deviation proportional to square of a difference of the threshold voltages is used, a difference of output current levels can be prevented between current output channels independent from each other and spaced far.

It will be apparent to those skilled in the art that various modifications and variations can be made in the data drive circuit for a current writing type AMOEL display panel of the present invention without departing from the spirit or scope of the invention. Thus, it is intended that the present invention cover the modifications and variations of this invention provided they come within the scope of the appended claims and their equivalents.

What is claimed is:

1. A data drive circuit for an AMOEL display panel comprising:

a pair of first transistors having a common gate terminal;

a second transistor for receiving an output current from the pair of first transistors;

a plurality of third transistors connected to a gate terminal of the second transistor, wherein the third transistor is formed a current mirror with the second transistor for mirroring the output current from the pair of first transistors; and, a plurality of fourth transistors respectively connected to the plurality of third transistors in series, wherein outputs of the plurality of fourth transistors are connected in parallel.

2. A data drive circuit as claimed in claim 1, further comprising a bias circuit connected to the common gate terminal of the pair of first transistors for prevention of floating of the common gate terminal.

3. A data drive circuit as claimed in claim 2, wherein the bias circuit comprising at least one transistor connected between the common gate terminal of the pair of first transistor and a ground in series.

4. A data drive circuit as claimed in claim 3, wherein the transistor is a NMOS transistor and a gate terminal of the transistor is connected to a second external bias voltage source.

5. A data drive circuit as claimed in claim 1, wherein the first and the fourth transistors are PMOS transistors, and the second and the third transistors are NMOS transistors.

6. A data drive circuit as claimed in claim 1, wherein one pair of first transistors has a body source connected together, which is connected to a first external bias voltage source, and the other of the pair of second transistors has a body and source connected together, which is connected to a positive voltage source.

7. A data drive circuit as claimed in claim 1, wherein a pair of first transistors has the same widths and lengths.

8. A data drive circuit as claimed in claim 1, wherein the fourth transistors control currents outputted from the third transistors in response to external n bit digital signals received as respective gate signal.

9. A data drive circuit as claimed in claim 1, wherein currents outputted from the fourth transistors are added together in parallel and provided as one driving current to one of the current output channels.

10. A data drive circuit as claimed in claim 9, wherein the driving current is regulated to have a current level of a binary form by combination of n bit digital signals received as gate signals of the fourth transistors.

11. A data drive circuit as claimed in claim 1, wherein widths and lengths of the third transistors is fixed so that currents thereto are 2a (a=0, 1, 2, - - - ) times of the output current from the pair of first transistors.

* * * * *